US009586790B2

(12) United States Patent
Tyni et al.

(10) Patent No.: US 9,586,790 B2
(45) Date of Patent: Mar. 7, 2017

(54) MONITORING OPERATING CONDITION OF AUTOMATIC ELEVATOR DOOR

(71) Applicant: KONE Corporation, Helsinki (FI)

(72) Inventors: Tapio Tyni, Hyvinkää (FI); Pekka Perälä, Kerava (FI); Jouko Kinnari, Espoo (FI)

(73) Assignee: KONE CORPORATION, Helsinki (FI)

( * ) Notice: Subject to any disclaimer, the term of this patent is extended or adjusted under 35 U.S.C. 154(b) by 413 days.

(21) Appl. No.: 14/266,077

(22) Filed: Apr. 30, 2014

(65) Prior Publication Data

US 2014/0339024 A1 Nov. 20, 2014

(30) Foreign Application Priority Data

May 17, 2013 (EP) ..... 13168178

(51) Int. Cl.
*B66B 1/34* (2006.01)
*B66B 5/00* (2006.01)
*B66B 13/14* (2006.01)

(52) U.S. Cl.
CPC ..... *B66B 5/0018* (2013.01); *B66B 5/0006* (2013.01); *B66B 13/146* (2013.01)

(58) Field of Classification Search
CPC . B66B 5/0018; B66B 5/0006; B66B 513/146; B66B 13/146
USPC ..... 187/313, 316, 317, 391, 393; 318/280–286, 466–470; 49/26, 28
See application file for complete search history.

(56) References Cited

U.S. PATENT DOCUMENTS 4,501,090 A * 2/1985 Yoshida ..... E05F 3/102 49/264
5,018,304 A * 5/1991 Longoria ..... E05F 15/63 49/26
6,002,217 A * 12/1999 Stevens ..... E05F 15/611 318/9
6,051,829 A * 4/2000 Full ..... B66B 13/26 187/317
6,854,565 B2 * 2/2005 Perala ..... B66B 5/0006 187/247

(Continued)

FOREIGN PATENT DOCUMENTS

WO WO 2005/073119 A2 8/2005

*Primary Examiner* — Anthony Salata
(74) *Attorney, Agent, or Firm* — Birch, Stewart, Kolasch & Birch, LLP

(57) ABSTRACT

An arrangement and a method for monitoring the operational condition of an automatic door in an elevator, particularly a passenger and/or goods elevator, or in a building, the arrangement includes an automatic door which includes one or more door leaves, which slide horizontally in their location, a door operator, which includes a door motor and a door mechanism for moving the door leaf horizontally in its location, a closing device for closing the automatic door, a control system for the door operator for controlling the door motor, a device configured to define the operational condition of the closing device and the door mechanism of the automatic door, the device configured to define the operational condition of the closing device and the door mechanism of the automatic door includes a mechanism configured to determine the mechanical energy of the shaft in the door motor of the automatic door during an operating cycle.

20 Claims, 2 Drawing Sheets

7 - elevator door
8 - door control card
9 - elevator control system
10 - landing doors
11- bus
12 - elevator door motor
13 - door switches
14 - encoder
15 - electric wiring
16 - bus
17 - bus

(56) References Cited

U.S. PATENT DOCUMENTS

| | | | | |
|---|---|---|---|---|
| 7,097,001 | B2 * | 8/2006 | Martin | B66B 13/24 187/290 |
| 7,109,677 | B1 * | 9/2006 | Gagnon | G05B 19/4061 160/29 |
| 7,151,350 | B2 * | 12/2006 | Haag | G01S 13/04 318/280 |
| 7,181,369 | B2 * | 2/2007 | Kanki | G05B 23/0243 702/182 |
| 8,981,681 | B2 * | 3/2015 | Malekpour | E06B 9/36 318/266 |
| 9,120,646 | B2 * | 9/2015 | Loeb | B66B 13/143 |
| 2006/0144643 | A1 * | 7/2006 | Koura | B66B 13/146 187/316 |
| 2008/0179143 | A1 | 7/2008 | Tyni | |
| 2008/0236955 | A1 | 10/2008 | Kattainen et al. | |
| 2011/0016971 | A1 | 1/2011 | Yulkowski et al. | |
| 2012/0029701 | A1 * | 2/2012 | Houser | E05F 15/40 700/275 |

* cited by examiner

7 - elevator door
8 - door control card
9 - elevator control system
10 - landing doors
11- bus
12 - elevator door motor
13 - door switches
14 - encoder
15 - electric wiring
16 - bus
17 - bus d - travelled distance
$E_{MS}$ -mechanical energy for door open/close cycle
$F_{\mu}$ - friction force resisting motion
$I_M(t)$ - door motor current
$k_s$ - springback factor of closing spring
P(t) - electric power used by electric motor
s - door state information
$U_M(t)$ - door motor voltage

MONITORING OPERATING CONDITION OF AUTOMATIC ELEVATOR DOOR

FIELD OF THE INVENTION

The invention relates to an arrangement and a method for monitoring the condition of an automatic door in an elevator, preferably an elevator suitable for transportation of passengers and/or goods, or in a building.

BACKGROUND OF THE INVENTION

An automatic door arrangement in a normal operational condition involves a certain amount of friction-induced friction force that resists motion. In case the magnitudes of the friction forces in the door arrangement can be found out by measurement or computationally, the information may be utilized for monitoring the performance and condition of the system.

An automatic door of an elevator consists of a car door moving with the car and operated by a door operator, which comprises a door motor and a door mechanism for moving one or more door leaves in their location horizontally, and landing doors which the car door captures along while on that floor. An elevator door of this kind, which slides automatically on a horizontal rail, is a part on which forces from various directions are exerted and which is in contact, both at its upper and lower edges, with the rail that keeps the door movement in its path. The friction force also resists the movement of the automatic door. The operation of the door may be disturbed, when a sufficient amount of dirt is accumulated on the door slide rail on the threshold of the elevator car. Due to this physical obstacle, the force resisting the motion of the door may become so high that, eventually, a door control system is no longer able to open or close the door.

A large part of elevator failures result from malfunctions in the automatic door of the elevator. Some of the door faults appear in such a way that it becomes heavier for the door motor to move the door. Because the door movement is controlled by a feedback adjuster that corrects changes of this type in the system, as long as there will be enough torque and power in the motor, the operation of the door appears fully normal outwards. Thus, in a feedback system there may be a failure in the making, or the system may originally have been mounted, adjusted or parameterized in a wrong way, but because of the feedback it will not appear outwards for a long time.

Publication EP 1713711 B1 discloses a method for monitoring the condition of an automatic door in a building, which method is based on force balances in a model for the door and on adapting model parameters using an optimization method. As initial data the method requires a current to torque function of a door motor that converts the current of the door to a torque produced by the door, transmission ratio of the door motor and the relating mechanism, by which the torque of the motor is converted to a linear force that moves the door leaves, and a force factor of a spring in a landing door closing device, or, if the closing device is a weight, mass of the weight. In the method, the current of the door motor (system excitation) and acceleration of a door leaf (system response) are to be collected to a buffer of the control system typically at a sampling frequency of 100 Hz during a door operating cycle. To this excitation/response data set are fitted the parameters of the force model such that the model produces as well as possible the same acceleration curve as that in the measured data. After fitting there are known the frictions of the door, the reduced masses of the door and the operational condition of the closing device. As initial data there are required the type of the motor and the current to torque curve of the motor, the type of the closing device, the mass of the weight and the elastic constant of the spring.

Management and parameterization of the required initial data is a challenging task in production and maintenance, requires investment and is sensitive to errors. To insert an optimization algorithm into an embedded elevator control system and to make it function reliably also pose problems, as do the processing and memory capacities required by the algorithm.

GENERAL DESCRIPTION OF THE INVENTION

The object of the invention is to solve the above-described prior art problems. A further object is to solve problems to be set forth later on in the description of the invention. The object is thus to provide an improved condition monitoring arrangement of an automatic door and an improved method for monitoring the condition of an automatic door, preferably in an elevator suitable for transportation of passengers and/or goods, or in connection with an automatic door in a building.

There are set forth, inter alia, embodiments which make it possible to reliably detect both the operational frictions of the elevator door and the operational condition of the closing device of the landing door. A failed automatic door can be brought back in compliance with the safety regulations quickly and cost-effectively.

Through the door data obtained by the method for monitoring the condition of the automatic door in accordance with the invention it is possible to reduce malfunctions, to enhance installation and maintenance processes and to improve user safety. After installation, the elevators will be of more uniform quality, which reduces the number of premature failures. In the service process it is possible to identify a suddenly faulted automatic door, and on the other hand, to detect a longer-term trend and to react proactively on a next, scheduled service call before the automatic door causes a failure and an extra service call. The method for monitoring the condition of the automatic door requires little computing resources and is easy to integrate with the control system for the automatic door and the elevator. With the condition monitoring parameters obtained by the method it is possible to improve and enhance the installation and service processes, to reduce fault alarms and to improve passenger safety.

Possible reasons for excessive door frictions may include, inter alia:

- After installation or service, the door motor is misadjusted, the guide rollers are excessively tight or the drive belt is excessively tight.
- In the lower guide groove there is caught extra matter, e.g. sand or other dirt, which decelerates the operation of the door.
- A mechanical impact on the door, whereby the door structures are twisted and friction is increased.
- The guide roller has a bearing defect, and consequently the bearing of the guide roller decelerates the motion of the door.
- Oil and dirt, dust and concrete crumbs, and the like, accumulating in the upper roller path stiffen the operation of the door.

Another possible mechanical defect, which increases friction, e.g. as a result of a failure in the bearing or gear system of the door motor.

Fraying, or jumping off a sheave, of the cable in the closing device of the landing door.

Installation and adjustment variations resulting from subsidence or stretches and contractions in a new building.

Even though the present method is unable to make a distinction between the reasons for increased friction, in other words, to diagnose a source of failure, an anomaly can be detected, however, and it can be deduced whether it is a car door of the elevator that is concerned, whereby friction increases on all floors, or whether it is a landing door, whereby friction increases only on a given floor. Thereafter, the service process may decide how to react to the detected event, by taking a measure either immediately or on a next, scheduled service call.

An important safety device is the spring- or weight-operated closing device for the landing door of the elevator. The open landing door, or the door with the lock open, must tend to close by itself. Naturally this is to prevent people from falling into the elevator shaft and serious consequences resulting therefrom, even death, in the worst case.

It is not common that the closing device of the landing door fails, but it is possible. Possible failure modes include snapping of the spring, snapping of the cable or jumping of the cable off the sheave. Even though the likelihood of failure is small, the consequences may be very serious. Therefore, a failure in the closing device constitutes a very high risk.

Calculation of parameters, and preparation of a condition evaluation or a service need may be performed either in a door operator control system, an elevator control system, a separate measuring system, a local user interface, a remote user interface or on a remote server.

The door operator control system refers to a device that controls the door motor. Advantageously the door operator control system includes a frequency converter or another controller that controls motion of an electric motor. Advantageously the door operator motor controller includes a micro controller or another programmable unit that is able to control the motor, to carry out measurements, to perform computational operations and to communicate measurements or results of computational operations to the elevator control system and to receive commands from the elevator control system so as to move the door. The door operator control system of a building may also make a decision itself on the actuation of the door, for instance, on the basis of information from a proximity sensor in the vicinity of the door.

The elevator control system refers to a device that controls the operation of the elevator. The elevator control system commands the door operator control system to move the door (e.g. door open or door closed). Advantageously the door operator control system performs a measurement on the voltage and current of the motor. Moreover, the door operator control system typically knows the open/closed state information of the door.

The arrangement of the invention for monitoring the operational condition of an automatic door in an elevator, in particular a passenger and/or goods transportation elevator, or in a building, comprises:

an automatic door comprising one or more door leaves that move in their location horizontally, a door operator comprising a door motor and a door mechanism for moving the door leaf in its location horizontally, a closing device for closing the automatic door, a door operator control system for controlling the door motor, means for defining the operational condition of the closing device and the door mechanism of the automatic door, wherein the means for defining the operational condition of the closing device and the door mechanism of the automatic door comprise means for determining mechanical energy of the door motor shaft of the automatic door during an operating cycle.

In a preferred embodiment, said means for determining the mechanical energy of the door motor shaft of the automatic door comprise:

means for producing door state information during an operating cycle, preferably for producing 'door open and door closed' state information.

means for determining mechanical power of the door motor shaft during an operating cycle.

In a preferred embodiment, said means for defining the operational condition of the door mechanism and/or the closing device of the automatic door comprise means for determining the magnitude of the friction force and/or the amount of potential energy stored in the door mechanism, during an operating cycle.

In a preferred embodiment, the means for defining the operational condition of the closing device and the door mechanism of the automatic door comprise a condition monitoring algorithm, which is implemented in a door operator control system, or an elevator control system, or a separate measuring system, or a local user interface, or a remote user interface, or a remote server.

In a preferred embodiment, the local user interface or the remote user interface of the automatic door is integrated to form part of the elevator control system.

In a preferred embodiment, the door operator control system is integrated to form part of the elevator control system.

In a preferred embodiment, the means for determining the state information of the automatic door during the operating cycle comprise:

an encoder, or the like, measuring the travel of the door, or door switches, which comprise 'door open' and 'door closed' switches, or a tachometer measuring the velocity of the door motor, or an accelerometer measuring the acceleration, velocity or location of the door.

In a preferred embodiment, said door motor is a DC or AC motor, preferably a single-phase or a multi-phase electric motor.

In a preferred embodiment, the door motor, the encoder measuring the travel of the door and the door switches are connected directly to the elevator control system through buses.

In a preferred embodiment, the door motor, the encoder measuring the travel of the door and the door switches are connected through buses to a door control card, which is connected to the elevator control system through a bus.

In a preferred embodiment, the automatic door comprises an elevator car door and an elevator landing door.

In a preferred embodiment, the condition monitoring algorithm is implemented by a door operator.

In a preferred embodiment, the condition monitoring algorithm is implemented in the elevator control system, if the control system of the door operator supplies sufficient measurement data to the control system.

In a preferred embodiment, the condition monitoring algorithm is implemented by separate measuring equipment that measures the open/closed state of the door as well as the voltage and current of the motor, and calculates the friction force and the potential energy stored in the closing device.

In a preferred embodiment, the condition monitoring algorithm is also implemented by a separate device, capable of computation, that receives sufficient measurement data from the door operator.

In a preferred embodiment, the condition monitoring algorithm may also be implemented by a separate device, capable of computation, that receives sufficient measurement data from the elevator control system.

In a preferred embodiment, the local user interface and the remote user interface are an integrated part of the elevator control system.

In a preferred embodiment, the door operator is an integrated part of the elevator control system.

In a preferred embodiment, the information 'door open/closed' is produced by switches of the type of mechanical on/off or Hall sensor-based on/off or Reed relay on/off or optical on/off, or an inductive proximity sensor or a capacitive proximity sensor.

In a preferred embodiment, the information 'door open/closed' is also produced by sensors of another type, such as a location sensor, e.g. an encoder, a laser or a potentiometer, or a velocity sensor, e.g. a tachometer or an accelerometer.

The arrangement and the method of the invention for monitoring the condition of an automatic door solve the problems associated with the known solutions and produce a larger part of the information, such as the frictions and the condition of the closing device, required by the control system.

In the method of the invention for monitoring operational condition there are determined the operational condition of an automatic door in an elevator, in particular a passenger and/or goods elevator, or in a building, the door comprising one or more door leaves, a door mechanism and/or a closing device, and performed at least the following steps of:

- determining state information of the door during an operating cycle, preferably the 'door open' and 'door closed' state information,
- determining mechanical power of the door motor shaft during an operating cycle,
- determining from the mechanical power of the door motor shaft mechanical energy of the shaft during an operating cycle,
- determining, on the basis of the mechanical energy of the door motor shaft and the door state information, the magnitude of a friction force and/or the amount of potential energy stored in the door mechanism,
- determining the operational condition of the door mechanism and/or the closing device on the basis of the magnitude of the friction force and/or the amount of the potential energy stored in the door mechanism.

In a preferred embodiment, from the amount of the potential energy stored in the door mechanism is determined the elastic constant or the mass of a weight of the closing device.

In a preferred embodiment, the door state information during the operating cycle comprises information on when the door is closed, preferably completely closed before opening, when the door is open, preferable completely open, and when the door is closed, preferably completely closed after opening.

In a preferred embodiment, the mechanical power of the door motor shaft is determined by measuring the current and voltage of the door motor during the operating cycle, by calculating the electric power of the door motor and by subtracting from the electric power the internal dissipation powers of the door motor, which include power losses caused by coil resistance of the motor.

In a preferred embodiment, the mechanical power of the door motor shaft is determined on the basis of the angular speed and torque of the door motor, preferably by measuring the torque with a force or torque sensor, or by measuring the current of the door motor and using a current to torque function of the door motor to estimate the torque.

In the method it is necessary to know a door opening width, which is an elevator system parameter to be configured in connection with delivery. The door opening width may also be advantageously measured by means of an encoder or another corresponding device during use. In the method, it is not necessary to gather information in control system buffers. Calculation in the method is simple, mainly addition, and no optimization algorithm is required, and consequently, the required condition monitoring arrangement with control systems is simple to implement and costs are low. The method does not require initial information on the properties of the door motor, nor on the elastic constant or the mass of a weight of the closing device. The method is robust. The method and arrangement for monitoring the condition of an automatic door is easy to implement in an elevator control system with a limited availability to memory and computational capacity.

BRIEF DESCRIPTION OF THE FIGURES

The invention will now be described in greater detail by means of preferred embodiments, with reference to the accompanying drawings, in which.

DETAILED DESCRIPTION OF THE INVENTION

Figure 1:
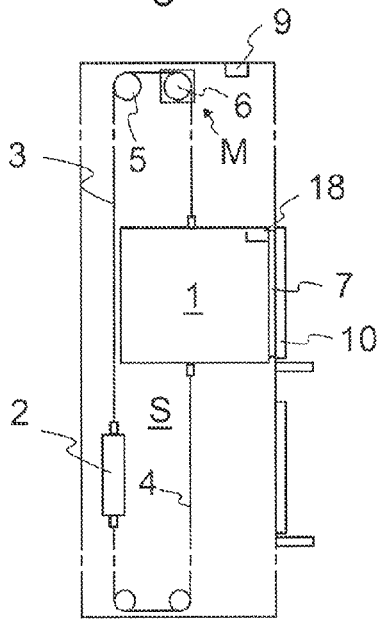
FIG. 1 shows schematically a preferred embodiment of an arrangement for monitoring the condition of an automatic door in an elevator in accordance with the invention, which arrangement may utilize the method of the invention.

FIG. 1 is a schematic side view of an arrangement for monitoring the condition of an automatic door in an elevator in accordance with an embodiment, the arrangement comprising an elevator car 1, a counterweight 2 and a suspension rope system 3 whose ropes interconnect said elevator car 1 and counterweight 2. The elevator car 1 and the counterweight 2 are arranged for being moved by exerting vertical force on at least the elevator car 1 or the counterweight 2 by means of elements M, 6, 3. The suspension rope system 3 comprises one or more ropes. The elevator is preferably a passenger and/or goods elevator that is mounted to travel in a shaft S in a building. In the embodiment of FIG. 1, means for exerting the force on at least the elevator car 1 or the counterweight 2 comprise the suspension rope system 3, which is connected to the elevator car and/or the counterweight, and a hoisting mechanism M, which comprises means for moving the suspension rope system 3, which means preferably comprise a drive device, e.g. a motor, and a drive member 6 to be rotated, preferably a drive wheel. The hoisting mechanism M is placed in the vicinity of the upper end of the path of the elevator car 1. The hoisting mechanism M is thus in power transmission connection with the elevator car 1 and the counterweight 2 through the suspension rope system 3, the hoisting mechanism M being arranged, in particular, to exert upward pulling force on the elevator car 1 or the counterweight 2 through the suspension rope system 3. In the lower part of the elevator car 1 and the counterweight 2 there is attached a compensation rope 4 to balance an imbalance torque caused by the suspension ropes. In the elevator car 1, the car doors 7 and the landing doors 10 are on the same wall with the elevator car 1. A door operator 18 comprises a door motor 12 and a door mechanism for moving a door leaf in its location horizontally.

The hoisting mechanism M may also be placed in the vicinity of the lower end of the path of the elevator car 1. The hoisting mechanism M is thus in power transmission connection with the elevator car 1 and the counterweight 2 through the hoisting rope system 4, the hoisting mechanism M being arranged, in particular, to exert downward pulling force on the elevator car 1 or the counterweight 2 through the hoisting rope system 4. In that case, in the normal drive of the elevator, a rope in the suspension rope system 3 need not transmit, through the outer surface of the rope, forces in the longitudinal direction of the rope, and no shearing forces in the direction of the surface are exerted on the load-bearing part of the rope or on an optional coating thereon. The ropes of the suspension rope system 3 may be suspended by deflecting about a rope pulley, which need not be a driven drive wheel. As presented, the elevator comprises a rope pulley 5 and/or rope pulleys in the vicinity of the upper and/or lower end of the path of the elevator car 1. Supporting on the rope pulley 5, for instance, a rope or ropes of the suspension rope system 3 carry the elevator car 1 and the counterweight 2. In the embodiments described this is implemented by 1:1 suspension, whereby the ropes of the suspension rope system 3 are connected by the first end to the elevator car 1 and by the second end to the counterweight 2. The suspension ratio may also be other than that, e.g. 2:1, but the ratio of 1:1 is advantageous, because in some embodiments a large number of rope deflections is not advantageous, due to the amount of space required by the deflections. Advantageously the rope pulleys are non-driven rope pulleys, and consequently the upper parts of the elevator may also be provided spacious. The rope pulleys are in an elevator shaft S, whereby no separate engine room is needed.

Figure 2:
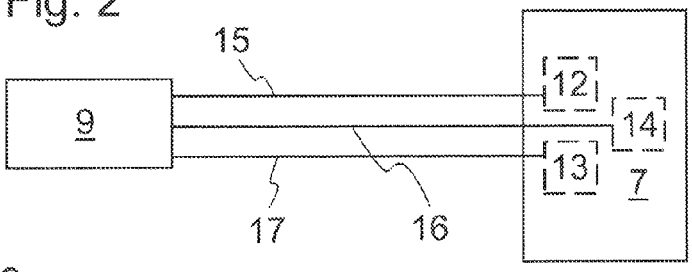
FIG. 2 shows schematically a preferred embodiment of the arrangement for monitoring the condition of the automatic door in accordance with the invention, in which actuators and sensors of the door are connected directly to an elevator control system.

FIG. 2 shows schematically an arrangement for monitoring the condition of an automatic door in accordance with an embodiment, in which the actuators and the sensors of the automatic door are connected directly to the control system of the elevator. The object is to provide a reliable and advantageous method for monitoring the condition of automatic doors in an elevator or a building. The arrangement of FIG. 2 for monitoring the condition of an automatic door in an elevator comprises an elevator door motor 12, an encoder 14, or the like, measuring a door travel, door switches 13, which comprise 'door open' or 'door closed' switches, electric wiring 15 for the elevator or building door 7 and the motor 12. Preferably the door motor 12 is a DC motor or an AC motor, preferably a single-phase or a multi-phase electric motor. Signals provided by the encoder 14 measuring the door travel pass along a bus 16. The travel may also be measured in some other way than with the encoder. The signals of the switches 13 pass along a bus 17. The door control system 9 of the elevator or the building controls the door motor 12 and reads the signals 16 and 17.

Figure 3:
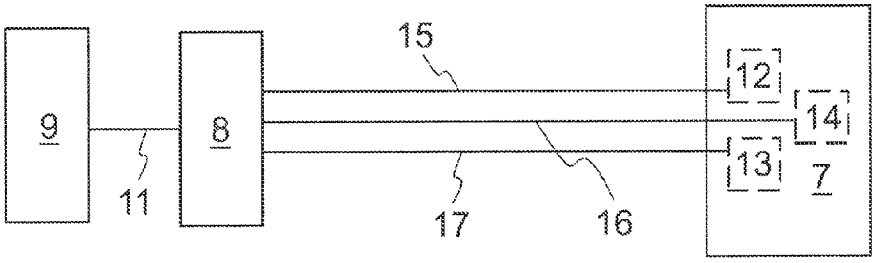
FIG. 3 shows schematically a preferred embodiment of the arrangement for monitoring the condition of the automatic door in accordance with the invention, in which actuators and sensors of the door are connected to a door control card, which is connected to an elevator control system.

FIG. 3 shows schematically the arrangement for monitoring the condition of the automatic door in accordance with an embodiment, in which actuators and sensors of the door are connected to a door control card 8, which is connected to an elevator control system 9. The arrangement of FIG. 3 for monitoring the condition of an automatic door in an elevator comprises an elevator door motor 12, an encoder 14, or the like, measuring a door travel, door switches 13, which comprise 'door open' or 'door closed' switches, electric wiring 15 for the elevator or building door 7 and the motor 12. Preferably the door motor 12 is a DC motor or an AC motor. Signals provided by the encoder 14 measuring the door travel pass along a bus 16. The travel may also be measured in some other way than with the encoder. The signals of the switches 13 pass along a bus 17. The door motor 12, the encoder 14 measuring the door travel, and the door switches 13 are connected to a door control card 8, which is connected to an elevator control system 9 along a bus 11. The door control system 9 of the elevator or the building controls the door control card 8, which controls the door motor 12 and reads the signals 16 and 17. By means of the current of the door motor 12 as a function of time $I_M(t)$ and the voltage of the door motor 12 as a function of time $U_M(t)$ it is possible to calculate the electric power used by the door motor 12. The electric power is consumed by copper and iron losses of the door motor 12 and mechanical work needed for moving the door 7.

Figure 4:
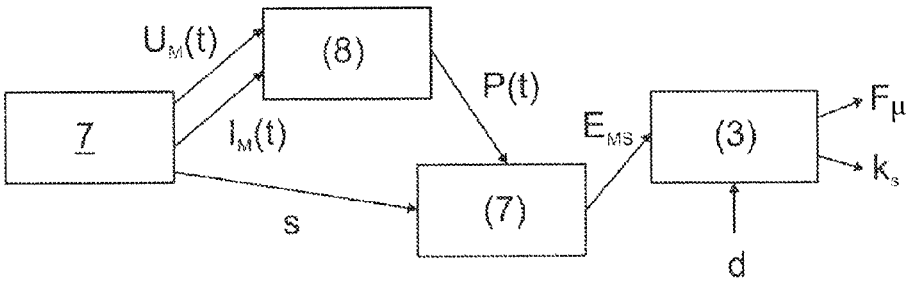
FIG. 4 is a block diagram of a preferred embodiment of a method for monitoring the condition of an automatic door in accordance with the invention.

FIG. 4 is a block diagram of an arrangement for monitoring the condition of an automatic door in accordance with an embodiment. By means of the current of the door motor 12 as a function $I_M(t)$ of time t and the voltage of the door motor 12 as a function $U_M(t)$ of time t it is possible to calculate the electric power P(t) used by the electric motor 12 as a function of time t. The electric power is consumed by copper and iron losses of the door motor 12 and mechanical work needed for moving the door 7. In accordance with the invention, the method measures the current $I_M(t)$ and voltage $U_M(t)$ of the door motor 12 and calculates a cumulative quantity, i.e. energy supplied to the door motor 12. During the door operation the mechanical energy applied to the system by the shaft of the door motor 12 is converted to kinetic energy of the door masses, to potential energy of the door closing device and is consumed by internal frictions in the door motor 12 and frictions in the door mechanism. In addition, door state information s is also needed. Particularly important points in the door operation are the door 7 completely closed, after a door cycle, and the door 7 completely open, when the door motor 12 keeps the door 7 open by torque.

Mechanical energy $E_{MS}$ used for a door open/closed cycle is an indication of the basic adjustments and operational condition of the door. When this energy is distributed onto a travelled distance d, the energy consumed can be normalized per meter travelled. This is called a friction force resisting motion Fμ, the unit thereof being Newton N. The friction force resisting the motion of the door mechanism can be calculated by equation:

$$F\mu=E_{MS}(\text{closed})(2d_{nom})^{-1} \quad (1)$$

where $E_{MS}$ is the mechanical energy of the motor shaft, which is consumed when the door was closed, it was opened, and after opening it was closed again, and $d=d_{nom}$ is the travel of the door.

When the door 7 is open, the shaft energy of the door motor 12 has not only be consumed in frictions but also stored as potential energy in the door closing device, preferably a spring, in other words, $$E_{MS}(\text{open})=F\mu d_{nom}+\tfrac{1}{2}k_S d_{nom}^2 \quad (2)$$

In formula (2), $k_S$ is a springback factor of the closing spring. In general, the opening and closing speeds of the door 7 are different. For reasons of impact energy and comfort the opening of the door 7 may usually take place faster than the closing. Formulae (1) and (2), used in this manner, involve an assumption that most of the friction is velocity-independent Coulomb friction and the share of velocity-dependent bearing frictions may be incorporated in this friction without any significant error.

The force factor of the spring can be obtained by formula (2)

$$k_S=(E_{MS}(\text{open})-F\mu d_{nom})2d_{nom}^{-2} \quad (3)$$

In formula (3) it is to be noted that $k_S$ is the effective elastic constant of the closing device with the assumption that the travel of the spring is the same as the nominal travel of the door. Preferably, in the doors, the spring is connected to a door leaf having the shortest travel. The number of leaves is preferably two or three. In that case, the respective transmission ratios are R=1/2 or R=1/3, and consequently $d_{nom}'=R\ d_{nom}$ must be substituted in formulae (1) and (2).

For condition monitoring it is sufficient to observe the value of the effective elastic constant, but if it is desired to compare a found value with a reference value, for instance, the transmission ratio has to be taken into account.

In case the closing device is based on a mass and the earth's gravity, a parameter representing the condition of the closing device, the mass of the closing weight $m_{CD}$ may be deduced in a corresponding manner $$m_{CD}=(E_{MS}(\text{open})-F\mu\cdot d_{nom})(gd_{nom})^{-1} \quad (4)$$

where g is the earth's gravitational acceleration 9.81 m/s$^2$.

The motor converts the input electric power $P_{ME}$ to mechanical shaft power $P_{MS}$. The conversion is not ideal, but electrical and mechanical losses occur therein $$P_{MS}=P_{ME}-P_{MML}-P_{cu}-P_{fe} \quad (5)$$

where $P_{ME}$ is the electric power supplied into the motor, $P_{MS}$ is the mechanical shaft power of the motor, $P_{MML}$ is the internal mechanical friction losses of the motor and gear system optionally integrated therewith, $P_{cu}$ is the losses produced in the motor circuitry, i.e. so-called copper losses, and $P_{fe}$ is the losses produced in the magnetic circuits of the motor, i.e. so-called iron losses.

The internal friction losses of the door motor 12, as well as the iron losses, are difficult to approach in a sufficiently simple manner in an application like this. On the other hand, it may be assumed that the internal frictions in the door motor 12 are small in comparison with the frictions in the whole door mechanism. The same applies to iron losses, and formula (5) may be simply written as $$P_{MS}=P_{ME}-P_{cu} \quad (6)$$

and the corresponding shaft energy over the time period observed $$E_{MS}=\int(P_{ME}(t)-P_{cu}(t)dt=\int(P_{ME}(t)-I_M(t)^2R_S(T))dt \quad (7)$$

In formula (7) $I_M$ is the motor current and $R_S(T)$ is the resistance of the motor circuit at actual temperature T of the motor. The resistance of the copper winding and current losses therewith vary along with the temperature, so the resistance of the winding is to be measured separately for each door operation. Another matter that supports online measurement of the resistance is that it enables omission of one parameter to be set in advance.

The resistance measurement is based on the fact that, when the motor shaft is locked into place, all the electric energy supplied to the motor converts to heat in the circuit of the motor. This situation occurs advantageously at least once during the door operating cycle, the door motor 12 keeping the door open by torque. In that case it must be that $$\int U_M(t)I_M(t)dt=\int I_M(t)^2R_S(T))dt \quad (8)$$

wherefrom it is easy to work out the searched $R_S(T)$ from the measurement data. In formula (8) $U_M$ is the voltage acting over the motor circuit.

In practice, the simplicity of formula (6) implies that the internal frictions in the door motor 12 and the iron losses of the door motor 12 are transferred as equivalent additional frictions to the door mechanism, and they cannot be distinguished therefrom. In a condition monitoring application that is not of importance, however, and at worst, an error in the order of 10% is concerned.

Preferably, in the door 7, the spring of the closing device is connected to a slower moving door and the elastic constant $k_S$ is calculated considering the transmission R.

The method is capable of reliably detecting both the operational frictions of the door and the operational condition of the closing device of the landing door.

If detected that the friction forces have increased and/or the condition deteriorated beyond a predetermined limit value, it is stated that the automatic door needs repair and work for maintenance or replacement of automatic door components is started.

Preferably the elevator is an elevator suitable for transporting passengers and/or goods, which is mounted in a building to move vertically, or at least substantially vertically, preferably on the basis of landing and/or car calls. The elevator comprises one or more elevator units and the elevator car preferably comprises an interior space that is most preferably suitable for receiving a passenger or several passengers. The elevator comprises preferably at least two, preferably more, landings to be served.

Inventive embodiments are also disclosed in the specification and drawings of this application. The inventive contents of the application may also be defined in ways other than those described in the following claims. The inventive contents may also consist of several separate inventions, particularly if the invention is examined in the light of expressed or implicit sub-tasks or in view of obtained benefits or benefit groups. In such a case, some of the definitions contained in the following claims may be unnecessary in view of the separate inventive ideas. Features of the different embodiments of the invention may be applied to other applications within the scope of the basic inventive idea.

Inventive embodiments are also disclosed in the specification and drawings of this application. The inventive contents of the application may also be defined in ways other than those described in the following claims. The inventive contents may also consist of several separate inventions, particularly if the invention is examined in the light of expressed or implicit sub-tasks or in view of obtained benefits or benefit groups. In such a case, some of the definitions contained in the following claims may be unnecessary in view of the separate inventive ideas. Features of the different embodiments of the invention may be applied to other embodiments within the scope of the basic inventive idea.

It is obvious to a person skilled in the art that as technology advances, the basic idea of the invention may be implemented in many different ways. The invention and its embodiments are thus not restricted to the above examples but may vary within the scope of the claims.

The invention claimed is:

1. An arrangement for monitoring the operational condition of an automatic door of an elevator, in particular of a passenger and/or goods elevator, or of a building, the arrangement comprising:

an automatic door comprising one or more door leaves that slide in their location horizontally;

a door operator comprising a door motor and a door mechanism for moving the door leaf in its location horizontally;

a closing device for closing the automatic door;

a control system of the door operator for controlling the door motor; and a device configured to define the operational condition of the closing device and the door mechanism of the automatic door, wherein the device configured to define the operational condition of the closing device and the door mechanism of the automatic door comprises a mechanism configured to determine mechanical energy of the shaft of the door motor of the automatic door during an operating cycle.

2. The arrangement of claim 1, wherein said mechanism configured to determine the mechanical energy of the shaft of the door motor of the automatic door comprises:

a device configured to produce door state information during an operating cycle; and a device configured to determine mechanical power of the shaft of the door motor during an operating cycle.

3. The arrangement of claim 1, wherein said device configured to define the operational condition of the door mechanism and/or the closing device of the automatic door comprises a mechanism configured to determine the magnitude of the friction force and/or the amount of potential energy stored in the door mechanism, during an operating cycle.

4. The arrangement of claim 1, wherein said device configured to define the operational condition of the closing device and the door mechanism of the automatic door comprises a condition monitoring algorithm, which is implemented:

in a control system of the door operator, or in an elevator control system, or in a separate measuring system, or in a local user interface, or in a remote user interface, or on a remote server.

5. The arrangement of claim 4, wherein the local user interface or the remote user interface of the automatic door is integrated to be part of the elevator control system.

6. The arrangement of claim 4, wherein said control system for the door operator is integrated to be part of the elevator control system.

7. The arrangement of claim 2, wherein said device configured to produce door state information of the automatic door during an operating cycle comprises:

an encoder measuring the travel of the door, or switches of the door, which comprise a force limiting switch for door open and door closed, or door in a given position, or a tachometer measuring the velocity of the door motor, or an accelerometer measuring the acceleration, velocity or location of the door.

8. The arrangement of claim 1, wherein the door motor is a DC motor or an AC motor.

9. The arrangement of claim 7, wherein the door motor, the encoder measuring the travel of the door, and the door switches are connected directly to the elevator control system through buses.

10. The arrangement of claim 7, wherein the door motor, the encoder measuring the travel of the door, and the door switches are connected through buses to a door control card, which is connected to the elevator control system through a bus.

11. The arrangement of claim 1, wherein the automatic door comprises an elevator car door and an elevator landing door.

12. A method for monitoring the operational condition of an automatic door of an elevator, particularly a passenger and/or goods elevator, or of a building, said method comprising the steps of:

determining the operational condition of the automatic door, which comprises one or more door leaves, a door mechanism and/or a closing device;

determining state information of the door during an operating cycle;

determining mechanical power of the shaft of the door motor during an operating cycle;

determining from the mechanical power of the shaft of the door motor mechanical energy of the shaft during an operating cycle;

determining, on the basis of the mechanical energy of the shaft of the door motor and the door state information, the magnitude of a friction force and/or the amount of potential energy stored in the door mechanism; and determining the operational condition of the door mechanism and/or the closing device on the basis of the magnitude of the friction force and/or the amount of the potential energy stored in the door mechanism.

13. The method of claim 12, further comprising the step of determining an elastic constant of the closing device or a mass of a weight from the amount of the potential energy stored in the door mechanism.

14. The method of claim 12, wherein the door state information during the operating cycle comprises information on when the door is closed, before opening, when the door is open, and when the door is closed, after opening.

15. The method of claim 12, wherein the mechanical power of the shaft of the door motor is determined by measuring the current and voltage of the door motor during the operating cycle, by calculating the electric power of the door motor and by subtracting from the electric power internal dissipation powers of the door motor, which comprise power losses induced by the coil resistance of the door motor.

16. The method of claim 12, wherein the mechanical power of the shaft of the door motor is determined on the basis of the angular velocity and torque of the door motor, or by measuring the current of the door motor and utilizing a current to torque function of the door motor for estimating the torque.

17. The method of claim 12, further comprising the step of monitoring the condition of the automatic door using an arrangement for monitoring the operational condition of an automatic door, the arrangement comprising:

an automatic door comprising one or more door leaves that slide in their location horizontally;

a door operator comprising a door motor and a door mechanism for moving the door leaf in its location horizontally;

a closing device for closing the automatic door;

a control system of the door operator for controlling the door motor; and a device configured to define the operational condition of the closing device and the door mechanism of the automatic door, wherein the device configured to define the operational condition of the closing device and the door mechanism of the automatic door comprises a mechanism configured to determine mechanical energy of the shaft of the door motor of the automatic door during an operating cycle.

18. The arrangement of claim 2, wherein said device configured to define the operational condition of the door mechanism and/or the closing device of the automatic door comprises a mechanism configured to determine the magnitude of the friction force and/or the amount of potential energy stored in the door mechanism, during an operating cycle.

19. The arrangement of claim 2, wherein said device configured to define the operational condition of the closing device and the door mechanism of the automatic door comprises a condition monitoring algorithm, which is implemented:

in a control system of the door operator, or
in an elevator control system, or
in a separate measuring system, or
in a local user interface, or
in a remote user interface, or
on a remote server.

20. The arrangement of claim 3, wherein said device configured to define the operational condition of the closing device and the door mechanism of the automatic door comprises a condition monitoring algorithm, which is implemented:

in a control system of the door operator, or
in an elevator control system, or
in a separate measuring system, or
in a local user interface, or
in a remote user interface, or
on a remote server.

* * * * *